US006823555B2

(12) United States Patent
Warren

(10) Patent No.: US 6,823,555 B2
(45) Date of Patent: Nov. 30, 2004

(54) BACKWASH BRUSH AND KIT THEREFOR

(76) Inventor: Darren S. Warren, 190 Beauchamp Rd., Winston-Salem, NC (US) 27106

( * ) Notice: Subject to any disclaimer, the term of this patent is extended or adjusted under 35 U.S.C. 154(b) by 175 days.

(21) Appl. No.: 09/965,084

(22) Filed: Sep. 28, 2001

(65) Prior Publication Data

US 2003/0061676 A1 Apr. 3, 2003

(51) Int. Cl.[7] ..... A47K 7/04

(52) U.S. Cl. ..... 15/176.2; 15/144.4; 15/210.1

(58) Field of Search ..... 15/144.4, 145, 15/176.1, 176.2, 210.1, 229.11, 229.13, 244.1; 206/15.2, 361, 362.2

(56) References Cited

U.S. PATENT DOCUMENTS

| | | | | | |
|---|---|---|---|---|---|
| 4,135,274 | A | * | 1/1979 | Freeman | 15/244.1 |
| 5,003,659 | A | * | 4/1991 | Paepke | 15/229.13 |
| 5,360,111 | A | * | 11/1994 | Arispe | 206/361 |
| 6,044,513 | A | * | 4/2000 | Penn | 15/118 |
| 6,088,868 | A | * | 7/2000 | Cerveny | 15/144.3 |
| 6,213,672 | B1 | * | 4/2001 | Varga | 403/109.2 |
| 6,415,470 | B1 | * | 7/2002 | Ramrattan | 15/144.4 |

* cited by examiner

*Primary Examiner*—Terrence R. Till

(57) ABSTRACT

A backwash brush having a telescoping handle to make it convenient to carry the brush in a kit also forming a part of this development. A variety of brushes are available for use with the device and the kit is housed in a pouch of small size sufficient to house the collapsed brush handle and brush for convenient storage during travel.

12 Claims, 2 Drawing Sheets

Fig. 2
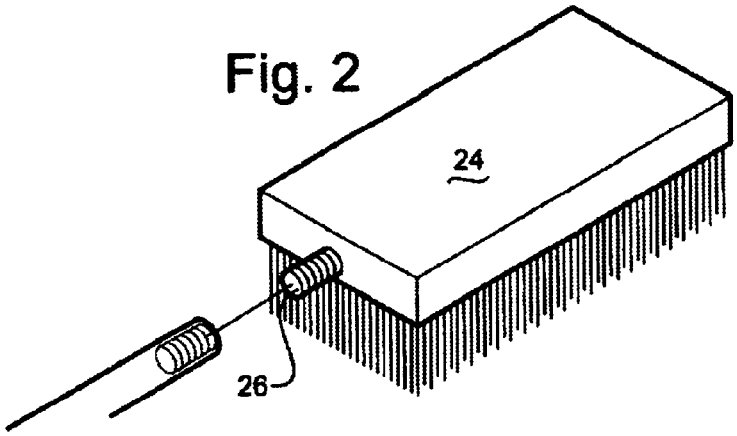
Fig. 5
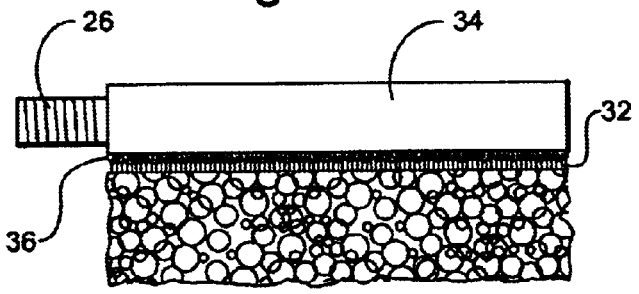
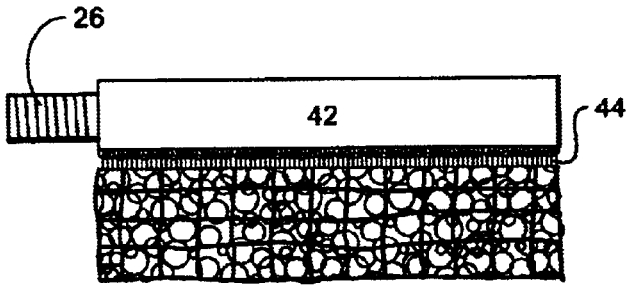
Fig. 6
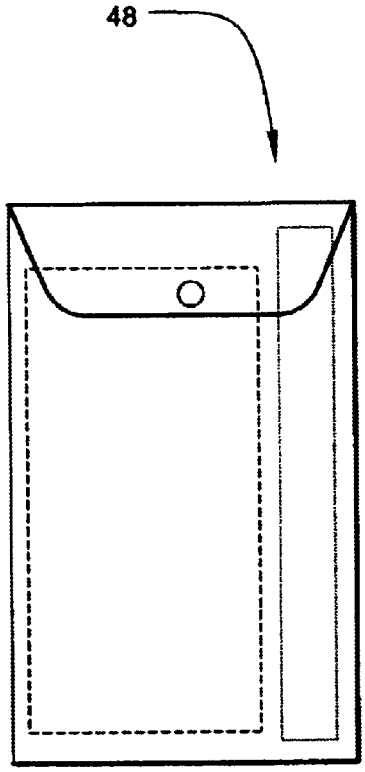
Fig. 7

BACKWASH BRUSH AND KIT THEREFOR

BACKGROUND OF THE INVENTION

1. Field of the Invention

The present invention relates generally to a brush for washing and more particularly to a back brush with an extendable handle which can be collapsed and carried within a pouch as a small kit.

2. Description of Prior Art

Brushes of every kind and description have been made for washing the body, accessories, furniture and every conceivable usable object that becomes tarnished or dirty. Body brushes usually take the form of brushes with flat handle that can be gripped and used to vigorously clean the hands, feet or other parts of the body. Soft and luxurious facial brushes have also been a part of the prior art for a considerable period of time. The only kind of brush not generally known to be available is one specifically designed for backwashing. Devices utilized for this purpose take the form of wall fixtures for the most part fastened to the wall of a shower stall that the user can back and move against the device to frictionally wash the back area. Some of these devices contain cleaning substance such as liquid soap which is dispensed when the back engages the device.

Other backwashing devices take the form of a banned or rope wherein a narrow extended portion is gripped at each end around the back of the user so that the arms can move back and forth to rub the length of the narrow portion against the back surface.

Some common washing brushes having extended handles have been utilized for backwashing from time to time, however these are lengthy and cannot be conveniently carried with the user is traveling away from home. These devices are not normally provided by hotels so that a frequent backwash user is deprived of that luxury when traveling away from his or her residence on business or for pleasure.

Because of this inconvenience which is heightened by an extended stay away from home, there has been identified a need to provide some compact form of a back brush that can be extended for a convenient use when traveling away from home but collapsed and easily carried during travel. It is to that need of providing a compact collapsed brush which can be packed in a small area but which will open in an extended manner to be utilized in an ordinary way that the present invention is directed.

SUMMARY AND OBJECTIVES OF THE PRESENT INVENTION

The present invention is for a back wash brush and a kit including the brush which can be collapsed for travel within the kit and fully extended for use when removed therefrom. The brush includes a telescoping handle movable between a fully extended position and a collapsed position having an appropriate means for maintaining the handle in the fully extended position and in the collapsed position. A brush is releasably secured to one end of the handle which has a base member and a wash pad releasably secured to the base member. The wash pad can take form of an ordinary soft bristle brush mounted on a wooden or plastic base, foliate or sponge material mounted on a base which is securable to the handle or a nylon or polyester web material mounted on a base which is secured to the handle. The bristle base can screw directly to the handle while the foliate material or nylon or polyester web material will need to be mounted to a base by convenient means such as hook and loop elements of any number of forms which then can be connected to the handle. The kit to transport the brush will be of a size to receive and enclose the brush and handle in the collapsed position which will conveniently be transportable in a small handbag.

From the foregoing summary it can be seen that a primary objective of the present invention is to provide a collapsible back brush that has all of the advantages of prior art devices and more and none of the disadvantages.

Another objective of the present invention is to provide a back brush of the type described having changeable brush members that address and meet the preference of the user.

Yet a further objective of the present invention is to provide the back brush in kit form wherein the handle can be collapsed and detached from the brush and the handle and brush then be fitted compactly and securely within a closed carrying case.

Thus there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In that respect, before explaining at least one embodiment of the invention in detail, it is to be understood that the invention is not limited in its arrangement of the components set forth in the following description and illustrated in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development. It is important that the claims be regarded as including such equivalent methods and products resulting therefrom that do not depart from the spirit and scope of the present invention. The application is neither intended to define the invention, which is measured by its claims, nor to limit its scope in any way.

Thus, the objects of the invention set forth above, along with the various features of novelty which characterize the invention, are noted with particularity in the claims annexed to and forming a part of this disclosure. For a better understanding of the invention, its operating advantages and the specific results obtained by its use, reference should be made to the following detailed specification taken in conjunction with the accompanying drawings wherein like characters of reference designate like parts throughout the several views.

The drawings are included to provide a further understanding of the invention and are incorporated in and constitute a part of this specification. They illustrate embodiments of the invention and, together with their description, serve to explain the principles of the invention.

BRIEF DESCRIPTION OF THE DRAWINGS

FIG. 2 is a perspective, exploded and partial view of the handle connection with the base member of the brush, the base member having an extended threaded detent which is cooperatively received by a threaded interior recess in the handle;

FIG. 5 is a side elevational view of foliate or sponge material attached to the base member by hook and loop elements;

FIG. 6 is a side elevational view of the nylon or polyester web material joined to the base member by hook and loop elements and held in rectangular configuration by sheer nylon net material; and FIG. 7 is a top plan view of the back wash brush kit showing the closure flap in the closed position and the collapsed handle and back brush in broken lines positioned within the kit.

DETAILED DESCRIPTION OF PREFERRED EMBODIMENTS

Figure 1:
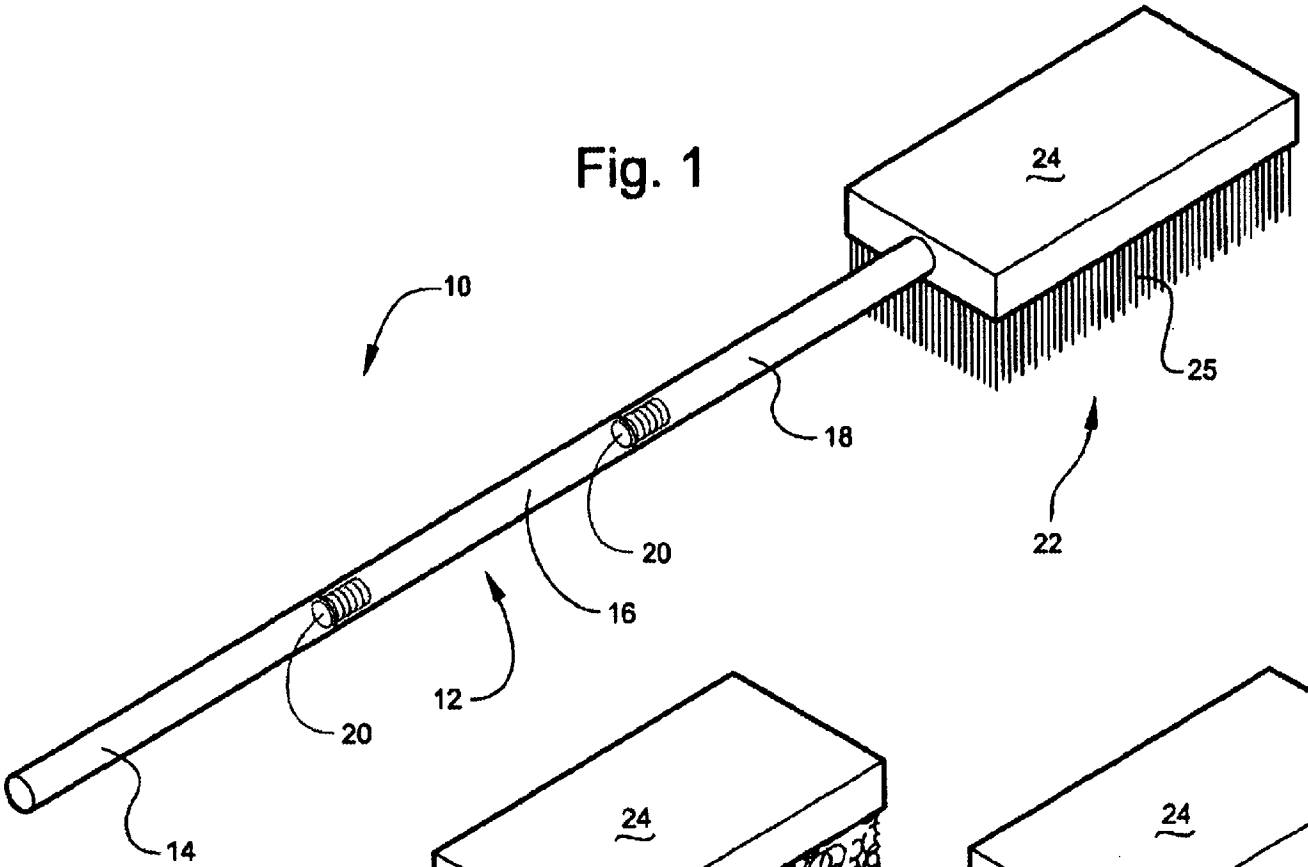
FIG. 1 is a perspective view of the collapsible back wash brush of the present invention with the handle in the extended position and with the brush being a normal bristle wash brush.

Referring now to the drawings and particularly to FIG. 1, a back wash brush show generally as 10 has a telescoping handle 12 including first, second and third sections 14, 16 and 18 with section 18 sliding into section 16 and section 16 and 18 sliding into section 14 in the collapsed position. When in the fully extended position as shown in FIG. 1, detents 20 are spring biased and operate to fix sections 14, 16 and 18 in the fully extended position in a conventional manner.

The brush shown generally as 22 includes a base member 24 to which, in FIG. 1, is embedded with bristles 25 to form a conventional wash brush. Alternatively, the bristles can be attached to a backing material which can then be affixed to base 24 by convenient means such as hook and loop elements.

Figure 4:
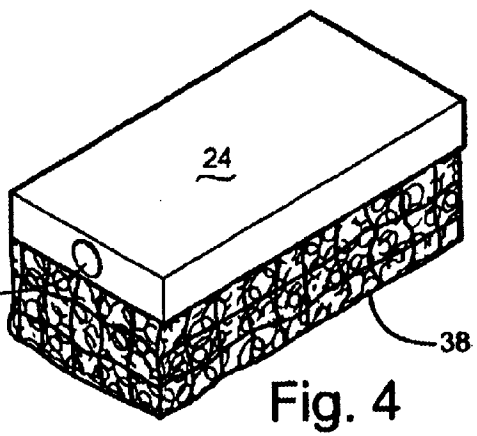
FIG. 4 is a perspective view of the nylon or polyester web material joined to a base member and held in rectangular configuration by sheer nylon net material.
Figure 3:
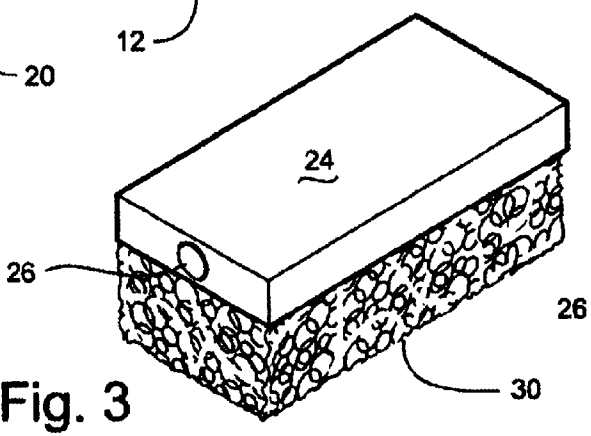
FIG. 3 is a perspective view of the foliate or sponge material brush joined to a base member.

Handle 12 can be connected to brush 22 in a number of ways including the use of a threaded detent 26 affixed to or formed with base 24 (FIG. 2) or the reverse arrangement where threaded recess 28 (FIGS. 3 and 4) cooperatively receives an exterior threaded section 18 (not shown). Obviously, there are other equally acceptable ways of joining handle 12 to brush 22.

A convenient hook 25 may be attached to the free end of handle 12 (the end of section 14 in FIG. 14) to hang the brush 10 in a convenient in the bathroom or shower.

Multiple brushes are usable in the present inventive concept such as, for example, the use of foliate or sponge material 30 (FIG. 3) secured to a backing 32 (FIG. 5) which in turn is connected to a base 34 as shown in FIG. 5. Hook and loop elements 36 attach foliate material 30 and backing 32 to base 34. Similarly, the nylon or polyester web material 38 is attached to a backing 40 which is secured to a base 42 by hook and loop elements 44 (FIG. 6). The nylon or polyester web material 38 may be held in a substantially rectangular configuration by sheer nylon net material 46 as shown in FIG. 6 or may be unshaped depending on the desire of the user.

The kit shown generally as 48 in FIG. 7 can be made up of a flexible material such as leather, plastic, or canvas in a rectangular shape and in a size sufficient to accommodate brush 24 and collapsed handle 12 shown in hidden lines in FIG. 7. A releasably securable closing flap 50 permits the closure of kit 48 to retain handle 12 and brush 24 therein until the kit is opened for use. The kit with its collapsible handle makes small convenient package easily carried in a small valise, carry on bag or other convenient traveling container.

From the proceeding description, it can be seen that a back wash brush and kit therefore have been provided that will meet all of the advantages of prior art devices and offer additional advantages not heretofore achievable. With respect to the foregoing invention, the optimum dimensional relationship to the parts of the invention including variations in size, materials, shape, form, function, and manner of operation, use and assembly are deemed readily apparent to those skilled in the art, and all equivalent relationships illustrated in the drawings and described in the specification are intended to be encompassed herein.

The foregoing is considered as illustrative only of the principles of the invention. Numerous modifications and changes will readily occur to those skilled in the art, and it is not desired to limit the invention to the exact construction and operation shown and described. All suitable modifications and equivalents that fall within the scope of the appended claims are deemed within the present inventive concept.

What is claimed is:

1. A backwash brush kit comprising: a telescoping handle movable between a fully extended position and a collapsed position; means for maintaining the handle in the fully extended position and in the collapsed position; a brush releasably secured to one end of the handle having a base member and a wash pad releasably secured to the base member, the wash pad including a backing and a wash material supported by the backing suitable to receive a washing substance and frictionally apply it to the back of a user; and a brush carrier of a size to receive and enclose the handle and the brush when the handle is in the collapsed position wherein the brush carrier has a releasably securable closing flap to prevent the handle and brush from being removed from the brush carrier when the closing flap is in the secured condition.

2. The kit as claimed in claim 1 wherein the brush includes a threaded detent, and the handle one end has an interior threaded recess, the detent being threadably engageable with the threaded recess to join the brush to the handle.

3. The brush kit as claimed in claim 2 wherein the wash pad is a plurality of bristles.

4. The brush kit as claimed in claim 2 wherein the wash pad is foliate material.

5. The kit as claimed in claim 1 wherein the wash pad is a plurality of bristles.

6. The brush kit as claimed in claim 5 wherein the wash pad backing is releasably secured to the wash pad base member by hook and loop elements.

7. The kit as claimed in claim 1 wherein the wash pad is a fine mesh material.

8. The kit as claimed in claim 7 wherein the brush includes a threaded detent, and the handle one end has an interior threaded recess, the detent threadably engageable with the threaded recess to join the brush to the handle.

9. The kit as claimed in claim 8 wherein the wash pad backing is releasably secured to the wash pad base member by hook and loop elements.

10. The kit as claimed in claim 9 where in the wash pad is a plurality of bristles.

11. The kit as claimed in claim 9 wherein the wash pad is a foliate material.

12. The brush kit as claimed in claim 6 wherein the brush includes a threaded detent, and the handle one end has an interior threaded recess, the detent threadably engageable with the threaded recess to join the brush to the handle.

* * * * *